United States Patent [19]

Poss

[11] Patent Number: 4,561,834

[45] Date of Patent: Dec. 31, 1985

[54] ROTARY VANED PUMPS WITH FIXED LENGTH AND SHEARING KNIFE-EDGED VANES

[75] Inventor: Werner Poss, Oakville, Canada

[73] Assignee: Poss Design Limited, Hamilton, Canada

[21] Appl. No.: 513,488

[22] Filed: Jul. 13, 1983

[51] Int. Cl.[4] ..... F04C 2/00; F04C 13/00

[52] U.S. Cl. ..... 418/150; 418/181; 418/255

[58] Field of Search ..... 418/46, 181, 255, 259, 418/270, 150

[56] References Cited

U.S. PATENT DOCUMENTS

| | | | |
|---|---|---|---|
| 619,653 | 2/1899 | Asbury et al. | 418/255 |
| 746,482 | 12/1903 | Evans | 418/255 |
| 1,196,977 | 9/1916 | Piatt . | |
| 2,585,406 | 2/1952 | Reynolds | 418/255 |
| 2,974,700 | 3/1961 | Waters | 418/255 |
| 3,995,977 | 12/1976 | Takahasi et al. | 418/255 |

FOREIGN PATENT DOCUMENTS

| | | | |
|---|---|---|---|
| 200950 | 12/1958 | Austria . | |
| 2235045 | 1/1974 | Fed. Rep. of Germany | 418/255 |
| 2407293 | 8/1974 | Fed. Rep. of Germany | 418/150 |
| 1020046 | 11/1952 | France | 418/181 |
| 1368221 | 6/1964 | France . | |
| 341337 | 1/1931 | United Kingdom | 418/181 |
| 591554 | 8/1947 | United Kingdom . | |
| 717273 | 10/1954 | United Kingdom | 418/181 |
| 910127 | 11/1962 | United Kingdom . | |

*Primary Examiner*—John J. Vrablik

*Attorney, Agent, or Firm*—Hirons, Rogers & Scott

[57] ABSTRACT

A rotary vaned pump has solid vanes of fixed length sliding in a boss mounted for rotation about a longitudinal axis eccentrically displaced from the longitudinal axis of the pump chamber, so as to provide respective pump compartments in the pump chamber which vary cyclically in volume and are arranged to pressurize fluid entering the pump chamber through an inlet opening and discharging from the chamber through an outlet opening. Each leading vane edge that passes over the inlet opening is formed as a shearing knife edge that shear-cuts any cuttable solid material in the entering fluid that is engaged by the edge as it enters the pump chamber through the inlet. Such solid material is thereby cut into pieces which can be handled by the pump without jamming rotation of the rotor. The leading edge of the inlet opening is also formed as a knife edge that cooperates with the vane edge to shear the solid material. The vanes slide radially in the rotor boss and their tips engage the rotor chamber cylindrical interior surface surrounding the longitudinal axis, this surface being formed as a specially calculated face cam permitting the use of the solid constant length vanes.

8 Claims, 9 Drawing Figures

ROTARY VANED PUMPS WITH FIXED LENGTH AND SHEARING KNIFE-EDGED VANES

FIELD OF THE INVENTION

This invention is concerned with improvements in or relating to rotary vaned pumps having vanes of fixed length, and especially to such pumps in which the vanes are provided with radial knife edges for cutting pumped material.

REVIEW OF THE PRIOR ART

The design and the manufacture of rotary vaned pumps are now mature arts, and such pumps are used extensively in many different fields. One severe limitation on their application to many uses is that solid material in the fluid being pumped can stop operation of the pump by jamming the rotor against rotation, and may also damage the pump vanes. In these circumstances the pump must be provided with an upstream filter that will stop such deleterious solid material before it reaches the pump inlet. There are however many applications in which the use of such a filter is not possible, since it is essential that the solid material be pumped together with the fluid in which it is being carried. One example of such an application is a sewage pump, since sewage typically is predominantly a liquid but with high solids content of widely different consistencies. Another example is apparatus for the mechanical separation of meat and bone into its components from a mixture thereof, where the pump is used to press the mixture under pressure against a perforated screen which will retain the bone component while permitting the meat component to pass through its perforations; such an apparatus is described, for example in my patent application Ser. No. 06/513,487, filed concurrently herewith.

DEFINITION OF THE INVENTION

It is therefore an object of the invention to provide a new rotary pump able to pump fluids containing certain solid materials with reduced possibility of jamming.

It is a more specific object to provide such a pump able to pump fluids containing shearable solid materials without jamming.

In accordance with the present invention there is provided a rotary vaned pump comprising:

a pump casing providing at least one pump chamber in its interior between axially spaced axial interior faces and a circumferential interior face;

an axial inlet opening in one of said axial interior faces to the pump chamber interior;

an outlet opening in one of said interior faces from the pump chamber interior;

a pump rotor mounted by the casing for rotation within the pump chamber about a pump rotor longitudinal axis and;

at least one pump vane of fixed length mounted by the pump rotor for rotation with the rotor about the said longitudinal axis;

each fixed length pump vane having its axial edges in engagement with the respective axial interior faces and having its radially outer edge in engagement with the interior circumferential face and forming between itself, the said interior axial and circumferential faces and the pump rotor at least one pump compartment receiving fluid entering through the said pump chamber inlet and discharging it through said pump chamber outlet;

wherein upon rotation of the fixed length pump vane with the pump rotor at least the portion of the radial leading edges of the pump vane which extend beyond the pump rotor and pass over the said axial inlet opening, and wherein the said portions of the radial leading edges that pass over the said axial inlet opening are formed as respective radial shearing knife edges for shear-cutting any shear-cuttable solid material entering the pump compartment through the axial inlet opening and engaged by the radial shearing knife edges.

Preferably the radial leading faces including the said portions of the radial leading edges are hollow ground to provide the shearing knife edges, and an edge of the said axial inlet opening facing the said pump vane shearing knife edges is formed as an inlet opening shearing edge cooperating with the pump vane knife edges to shear-cut solid material interposed between them.

The said pump vane extends on both sides of the pump rotor longitudinal axis and has both of its radial leading edges formed as shearing knife edges, and is mounted by the pump rotor for radial movement therein, the pump chamber being formed about a chamber longitudinal axis radially displaced from said rotor longitudinal axis so that each pump compartment formed by the pump vane decreases in volume as the pump vane moves from the said inlet opening toward the said outlet opening and increases in volume as the pump vane moves from the said outlet opening toward the said inlet opening. The said pump chamber circumferential interior face constitutes an interior cam face moving the fixed length pump vane radially in the pump rotor as the rotor rotates with both of the pump vane radial edges always in operative contact with the said interior cam face.

Also in accordance with the invention there is provided a rotary vane pump comprising:

a pump casing providing at least one pump chamber in its interior between axially spaced axial interior faces and a circumferential interior face;

an inlet opening in one of said interior faces to the pump chamber interior;

an outlet opening in one of said interior faces from the pump chamber interior;

a pump rotor mounted by the casing for rotation within the pump chamber about a pump rotor longitudinal axis;

at least one pump vane mounted by the pump rotor for rotation with the rotor about the said longitudinal axis;

each pump vane having its axial edges in engagement with the respective axial interior faces and having its radially outer edge in engagement with the interior circumferential face and forming between itself, the said interior axial and circumferential faces and the pump rotor at least one pump compartment receiving fluid entering through the said pump chamber inlet and discharging it through said pump chamber outlet;

wherein each pump vane is of fixed radial length and is mounted by the pump rotor for radial movement therein, and wherein the said pump chamber circumferential interior face constitutes an interior cam face moving the pump vane radially in the pump rotor as the rotor rotates with both of the pump vane radial edges in operative contact with the said interior cam face.

DESCRIPTION OF THE DRAWINGS

Pumps which are particular preferred embodiments of the invention will now be described, by way of example, with reference to the accompanying diagrammatic drawings, wherein.

Similar parts are given the same reference number in all of the figures of the drawings.

DESCRIPTION OF THE PREFERRED EMBODIMENTS

Figure 1:
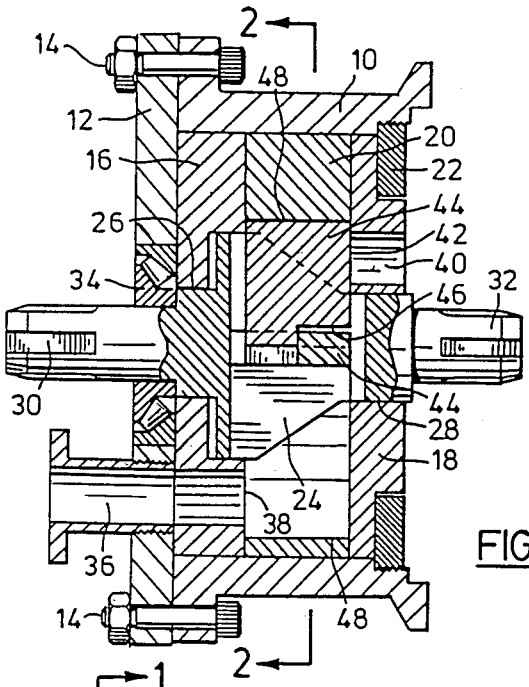
FIG. 1 is a longitudinal cross-section taken on line 1—1 of FIG. 2 of a first embodiment intended for use as an intermediate member in apparatus employing the pump, such as a machine for the mechanical separation of meat and bone, the pump having an axial inlet and an axial outlet.
Figure 2:
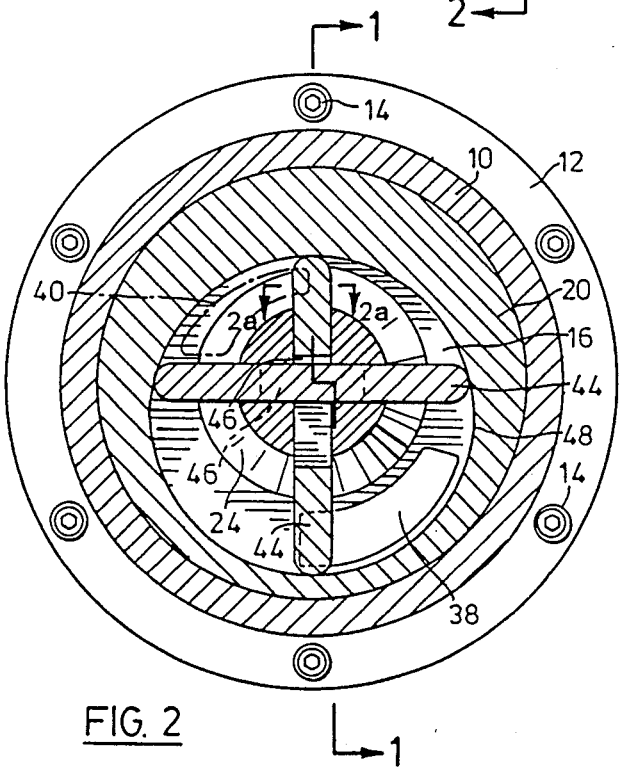
FIG. 2 is a transverse cross-section of the pump of FIG. 1 taken on the line 2—2 of FIG. 1.

The embodiment of FIGS. 1 and 2 is a rotary, radial-vaned, positive displacement pump intended especially for use in apparatus for the mechanical separation of meat and bone into separate fractions by forcing the meat and bone mixture under high pressure against a perforated screen, the meat fraction passing through the screen while the bone fraction is retained by the screen. Such a separator is described in my application Ser. No. 06/513,487, filed concurrently herewith. The pump comprises a cylindrical housing 10 having its front end closed by a circular front end plate 12 bolted thereto by axial bolts 14. Front and rear bearing plates 16 and 18 are mounted in the housing 10 on either side of a hollow cam plate 20, the three plates thereby forming the pump chamber between them. The rear bearing plate 18 also constitutes a rear end plate for the pump and is retained in the housing by a retaining ring 22 screw threaded into the housing. A pump rotor 24 is mounted in the pump chamber for rotation about a respective longitudinal axis by means of two cylindrical plain bearing portions 26 and 28 mounted respectively in the bearing plates 16 and 18. One end 30 of the rotor shaft is splined for driving engagement by a suitable rotor means, while the other end 32 of the shaft protrudes from the rear end plate 18 and is also splined so that it can drive another apparatus connected thereto, a thrust roller bearing 34 being provided mounted in the end plate 12.

A circumferentially elongated axial inlet 36 having an opening 38 to the pump chamber in the respective axial face thereof is provided in the front end plate 16, while a circumferentially elongated axial outlet 40 having an opening 42 to the pump chamber in the other axial face thereof is provided in the rear end plate 18, the two openings being disposed diametrically opposed from one another about the axis of rotation of the rotor. This particular embodiment is provided with two radially extending pump vanes 44 of fixed length, each sliding radially in a respective radial slot in the rotor boss, the two slots and therefore the two blades being disposed at right angles to one another. Both blades are of an axial width to fit without appreciable play between the two facing axial faces of the end bearing plates 16 and 18, and they are both provided with mating complemetary half-width radially elongated slots 46 to permit the required radial sliding movements in the rotor boss as it rotates about its longitudinal axis. The radial edges or tips of the blades engage an internal cam surface 48 provided by the hollow cam plate 20 and constituted by the internal circumferential face thereof, which is therefore also the circumferential radially inner surface of the pump chamber, the tips being rounded to facilitate the rubbing contact as they move over the surface.

The internal cam surface 48 is generated about a longitudinal axis that is parallel but displaced from the longitudinal axis of rotation of the rotor by an amount referred to as the eccentricity, so that in known manner as the rotor and the vanes rotate the separate pump compartments formed between the vanes and the pump chamber walls increase and decrease cyclically in volume, the volume decreasing from the inlet to the outlet and increasing from the outlet to the inlet. The surface 48 is also generated so that at all times during the rotation of the pump rotor the vane tips are in positive contact with it, so that the contents of the pump compartments are positively displaced through the pump from the inlet to the outlet and relatively high pump pressures, e.g. up to 140 kg/sq.cm (2000 p.s.i.) can readily be generated. The cam profile is therefore a relatively complex shape the points of which must be individually computed; a preferred procedure for such a computation is given below.

Figure 2A:
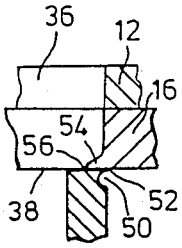
FIG. 2*a* is a plane cross-section of a detail of the pump of FIGS. 1 and 2, taken on the line 2*a*—2*a* of FIG. 2.

The radially-extending faces of the vanes that are in rubbing contact with the face of the bearing plate 16, and which therefore traverse the inlet opening 38, are hollow ground at 50 (FIG. 2*a*) to form respective radially-extending shearing knife edge 52 that will shear-cut any solid material protruding through the opening 38 into the pump chamber. The use of the specially generated cam 48 permits the use of solid vanes of constant length that are particularly suited for the provision of the hollow ground portions 50 and the knife edges 52. It will be understood by those skilled in the art that there is of course a limit to the hardness and/or thickness of the solid materials that can be cut by the vane knife edges, and it is not intended for example that they will be able to cut metal pieces of any very substantial thickness, but in this embodiment the vanes are of thickness about 12.7 mm (0.5 in.) and the rotor is rotated by a motor of about 50 h.p., so that solid materials of the properties of animal bone are easily sheared. Any such piece of solid material entering the pump chamber will immediately be cut by the shearing edges into pieces of sufficiently smaller size to pass with the vanes in the respective pump compartment and out of the outlet 40.

The leading edge of the inlet opening 38 is also formed at 54 with a protrusion providing a shearing edge 56 that cooperates with the cutting edge 52 to shear cut any shear-cuttable material that becomes interposed between them. The pump is therefore fully capable of passing and positively pumping mixtures containing many different kinds of solid materials, such as sewage or mixtures of meat and bone to be separated, without danger that the pump will be jammed and stopped by solid material becoming jammed between the edges of the inlet and the vanes.

Figure 3:
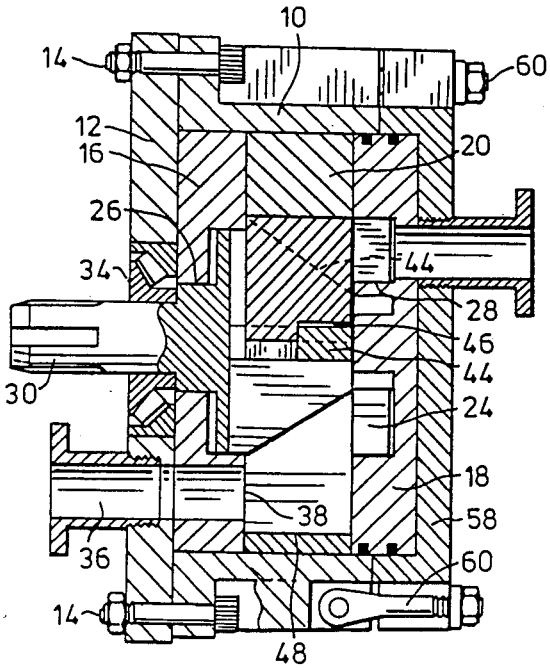
FIG. 3 is a longitudinal cross-section similar to FIG. 1 of a second embodiment intended for use as a separate entity, the pump also having an axial inlet and an axial outlet.

FIG. 3 illustrates a second embodiment of the invention comprising a pump not intended for direct mechanical incorporation in another piece of machinery. The bearing portion 28 of the rotor is therefore of annular form and the splined shaft end 32 is omitted. The bearing plate 18 is retained by a removable end plate 58 held to the casing 10 by pivoted clamp bolts 60.

Figure 4:
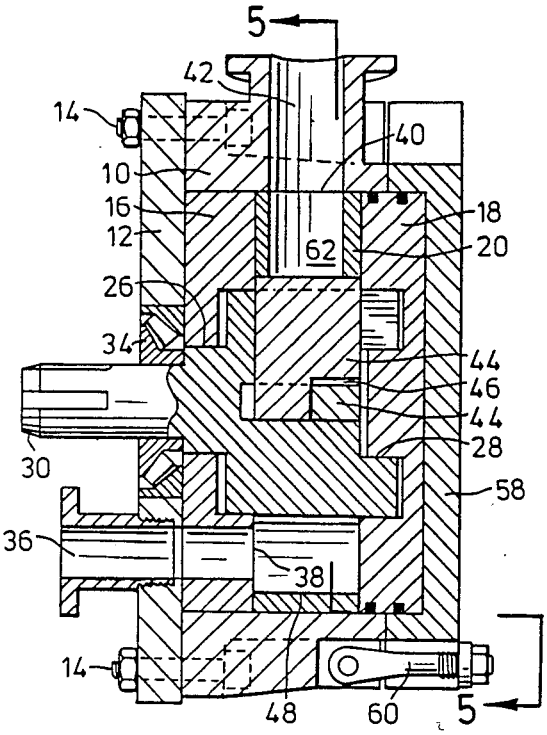
FIG. 4 is a longitudinal cross-section similar to FIG. 3 of a third embodiment taken on the line 4—4 of FIG. 5, the pump having an axial inlet and a radial outlet.
Figure 5:
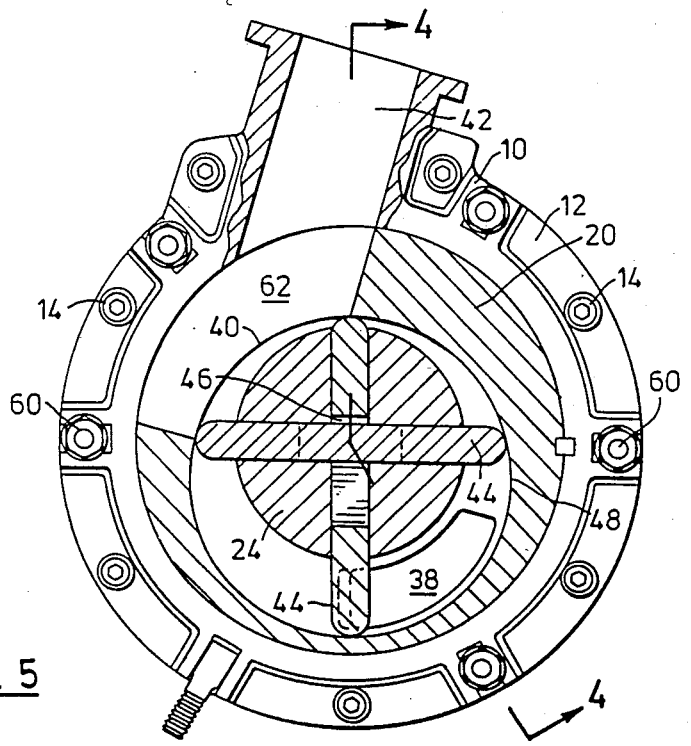
FIG. 5 is a transverse cross-section through the pump of FIG. 4, taken on the line 5—5 of FIG. 4.

In the third embodiment of FIGS. 4 and 5 the inlet 36 is axial but the outlet 40 from the pump chamber discharges radially, a corresponding radial outlet passage 62 being provided in the cam body 20.

Figure 7:
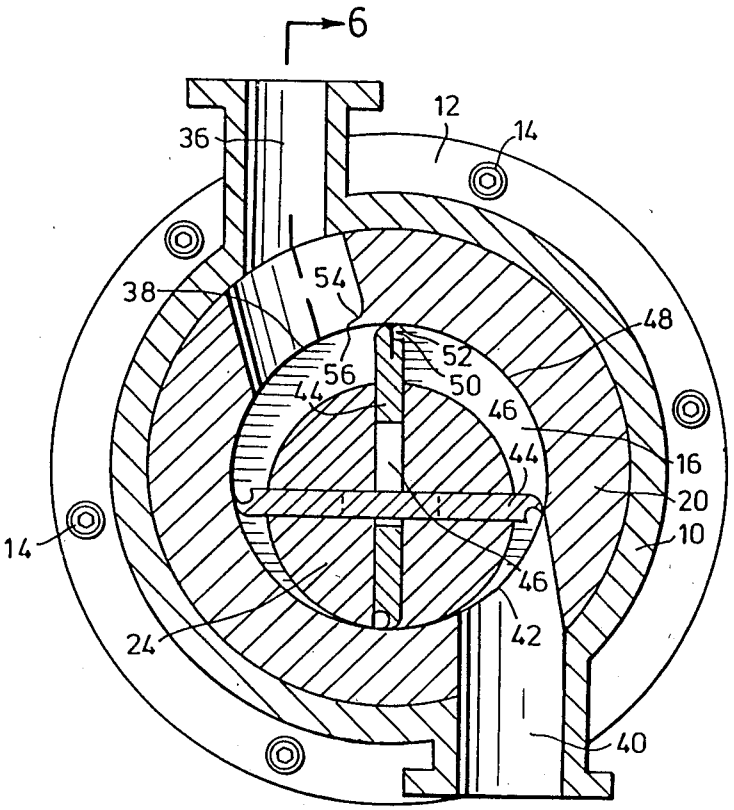
FIG. 7 is a transverse cross-section through the pump of FIG. 6, taken on the line 7—7 of FIG. 6.
Figure 6:
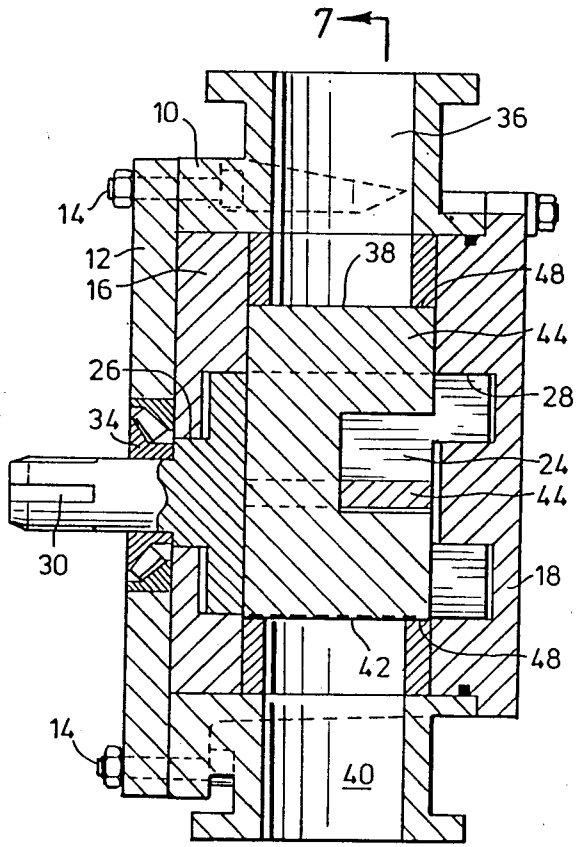
FIG. 6 is a longitudinal cross-section similar to FIGS. 3 and 4 of a fourth embodiment taken on the line 6—6 of FIG. 7, the pump having a radial inlet and a radial outlet.

In the embodiment of FIGS. 6 and 7 both the inlet 36 and the outlet 42 are radial with respect to the longitudinal axis of the rotor, so that both of the openings 38 and 40 are provided in the cam face 48. The hollow portions 50 forming the knife edges 52 are therefore provided in the axial leading edges of the vane tips, while the radial inlet opening 38 is provided with the projection 54 and its cooperating shearing edge 56.

Figure 8:
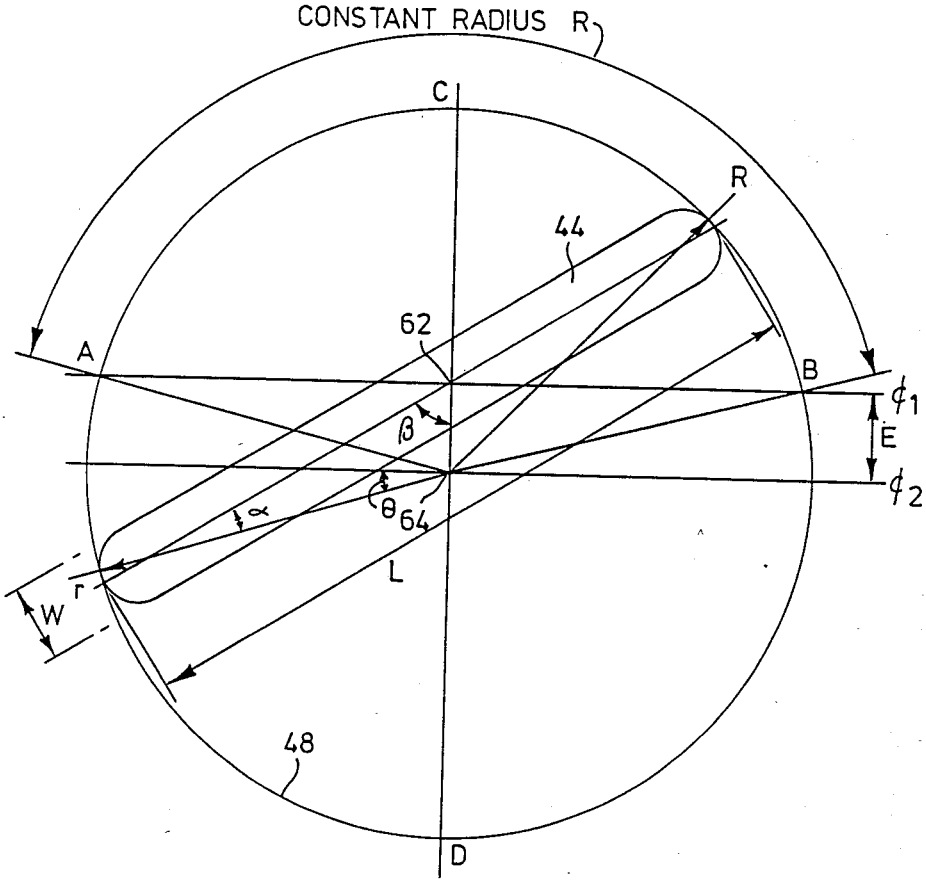
FIG. 8 is an outline diagram of the internal cam face of the positive displacement pump in side elevation and a rotor blade to accompany a description of the manner of calculating the cam face profile to permit its manufacture.

FIG. 8 shows diagrammatically the side elevation of the cam face 48 and a single vane 44 stopped in a single position. The diagram shows the centre line $\not{c}_1$ of the rotor having its longitudinal axis of rotation at centre 62, and the centre line $\not{c}_2$ of the cam having its longitudinal axis of rotation at centre 64. The distance between the longitudinal axes at 62 and 64 is the eccentricity E which is known. The blade length L and thickness W are both known. The centre lines of the blades must always pass through the centre 62 while the eccentricity E is directly proportional to the volume output of the pump and locates the imaginary centre 64 of the cam. The rotor blades must seal the spaces between the rotor blades at all times, and therefore must at all times and in all positions of the rotor be in touch with the cam at both ends.

It is arbitrarily chosen that the maximum arc shall be of constant radius R, and this is the arc ACB centered at 64 with chord equal to the blade length L. Some correction must be made to L to account for the width of the blade and for the rounded tips of radius W/2. The variable cam radius r measured from centre 64 will vary with the angle $\theta$, between the centre line $C_2$ and the radius r being determined and can be calculated geometrically, but an exact equation solution is not easily attainable. The problem is particularly suited to an iterative approach, especially with the use of a computer to effect the relatively large number of calculations required to obtain the values of the cam radius necessary for the required accuracy of manufacture, which will of course depend among other factors, on the application for which the pump is intended.

A value known to be a practical value is assumed for the angle $\alpha$ between the blade centre line and a radius through the centre 64. Angle $\beta$ can then be determined for any subsequent value of $\alpha$ knowing that the sum of angles $\alpha+\beta+\theta$ must be 90 degrees.

The values of variable cam radius r can then be calculated from the relationships $$\frac{\left(r-\frac{W}{R}\right)}{\sin\beta}=\frac{E}{\sin\alpha} \tag{1}$$

and $$\left(R-\frac{W}{2}\right)^2=\left(r-\frac{W}{2}\right)^2+(L-W)^2-2\left(r-\frac{W}{2}\right)(L-W)\cos\alpha \tag{2}$$

both of which must be satisfied. If the agreement is not within the required tolerance $\alpha$ must be adjusted and the procedure repeated until it is. All of the points on the non-constant radius are ADB can be calculated using the different values of $\theta$ involved.

Other forms of rotary vaned pumps may also be employed in which the vanes are of fixed length, for example a pump of the type in which the vanes are mounted in radial slots in the rotor with their parallel largest faces parallel to the axis of rotation; the two radially-extending edges of each vane engage complementary face cams on the two facing end walls and, as the rotor rotates, cause the vanes to slide axially of the rotor in their radial slots to vary cyclically the volumes of the chambers formed between the rotor and the end wall face cams. The shearing knife edge will, as with the previously-described embodiments, be provided at the edges which traverse the inlet aperture.

I claim:

1. A rotary vaned pump comprising:

a pump casing providing at least one pump chamber in its interior between axially spaced axial interior faces and a circumferential interior face;

an axial inlet opening in one of said axial interior faces to the pump chamber interior;

an outlet opening in one of said interior faces from the pump chamber interior;

a pump rotor mounted by the casing for rotation within the pump chamber about a pump rotor longitudinal axis; and at least one pump vane of fixed length mounted by the pump rotor for rotation with the rotor about the said longitudinal axis;

each fixed length pump vane having its axial edges in engagement with the respective axial interior faces and having its radially outer edge in engagement with the interior circumferential face and forming between itself, the said interior axial circumferential faces and the pump rotor at least one pump compartment receiving fluid entering through the said pump chamber inlet and discharging it through said pump chamber outlet;

the fixed length pump vane being mounted by the pump rotor for radial movement therein and the said pump chamber being formed about a chamber longitudinal axis radially displaced from said rotor longitudinal axis so that each pump compartment formed by the pump vane decreases in volume as the pump vane moves from the said inlet opening toward the said outlet opening and increases in volume as the pump vane moves from the said outlet opening toward the said inlet opening, the said pump chamber circumferential interior face constituting an interior cam face moving the fixed length pump vane radially in the pump rotor as the rotor rotates with both of the pump vane radial edges always in operative contact with the said interior cam face, wherein upon rotation of the fixed length pump vane with the pump rotor at least the portions of the radial leading edges of the pump vane which extend beyond the pump rotor pass over the said axial inlet opening, and wherein the said portions of the radial leading edges that pass over the said axial inlet opening are formed as respective radial shearing knife edges for shear cutting any shear-cuttable solid material entering the pump compartment through the axial inlet opening and engaged by the radial shearing knife edges.

2. A rotary vane pump as claimed in claim 1, wherein the radial leading faces of the vanes including the said portions of the radial leading edges that pass over the axial inlet opening are hollow ground to provide the shearing knife edges.

3. A rotary vaned pump as claimed in claim 1 or 2, wherein an edge of the said axial inlet opening facing the said pump vane shearing knife edges is formed as a shearing edge cooperating with the pump vane knife edges to shear cut solid material interposed between them.

4. A rotary vaned pump as claimed in claim 1 or 2, and including two fixed length pump vanes mounted by the pump rotor at right angles to one another, each pump vane extending on both sides of the pump rotor longitudinal axis and having both of the leading portions of its radial edges formed as shearing knife edges.

5. A rotary vaned pump comprising:

a pump casing providing at least one pump chamber in its interior between axially spaced axial interior faces and a circumferential interior face;

an axial inlet opening in one of said axial interior faces to the pump chamber interior;

an outlet opening in one of said interior faces from the pump chamber interior;

a pump rotor mounted by the casing for rotation within the pump chamber about a pump rotor longitudinal axis and;

at least one pump vane of fixed length mounted by the pump rotor for rotation with the rotor about the said longitudinal axis;

each fixed length pump vane having its axial edges in engagement with the respective axial interior faces and having its radially outer edges rounded and in engagement with the interior circumferential face and forming between itself, the said interior axial and circumferential faces and the pump rotor at least one pump compartment receiving fluid entering through the said pump chamber inlet and discharging it through said pump chamber outlet;

wherein the said pump chamber is formed about a chamber longitudinal axis radially displaced from said rotor longitudinal axis so that each pump compartment formed by the pump vane decreases in volume as the pump vane moves from the said inlet opening toward the said outlet opening and increases in volume as the pump vane moves from the said outlet opening toward the said inlet opening;

wherein each pump vane of fixed radial length is mounted by the pump rotor for radial movement therein;

wherein the portions of the radial leading edges of the pump vane that pass over the said axial inlet opening are formed as respective radial shearing knife edges for shear cutting any shear-cuttable solid material entering the pump compartment through the axial inlet opening and engaged by the radial shearing knife edges;

wherein the said pump chamber circumferential interior face consitutes an interior cam face moving the pump vane radially in the pump rotor as the rotor rotates with both the pump vane radial edges in operative contact with the said interior can face, and wherein the said interior cam face radius has a circular arc portion of constant radius R of chord length equal to the pump vane blade length L corrected for blade width and for the radius W/2 of the rounded outer pump vane edges, and has the remaining arc portion of variable radius r calculated from the three relationships:

$$\frac{\left(r - \frac{W}{R}\right)}{\sin \beta} = \frac{E}{\sin \alpha} \tag{1}$$

$$\left(R - \frac{W}{2}\right)^2 = \left(r - \frac{W}{2}\right)^2 + (L - W)^2 - 2\left(r - \frac{W}{2}\right)(L - W)\cos \alpha \tag{2}$$

and $$\alpha + \beta + \theta = 90^\circ \tag{3}$$

where E is the pump eccentricity determined by the displacement between the chamber and rotor longitudinal axes, $\alpha$ is the angle between the blade centre line and the radius r through the imaginary cam longitudinal axis, and $\theta$ is the angle between the cam centre line and the radius r through the imaginary cam longitudinal axis.

6. A rotary vane pump as claimed in claim 5, and including two fixed length pump vanes mounted by the pump rotor at right angles to one another for radial movement therein, each pump vane extending on both sides of the pump rotor longitudinal axis, the portions of the radial leading edges of both of the pump vanes that pass over the said axial inlet opening being formed as respective radial shearing knife edges.

7. A rotary vaned pump as claimed in claim 5, wherein the radial leading face of the vane including the said portions of the radial leading edges that pass over the axial inlet opening are hollow ground to provide the shearing knife edges.

8. A rotary vaned pump as claimed in claim 5 or 6, wherein an edge of the said axial inlet opening facing the said pump vane shearing knife edges is formed as a shearing edge cooperating with the pump vane knife edges to shear cut solid material interposed between them.

* * * * *